United States Patent [19]

Tenham et al.

[11] Patent Number: 4,934,953

[45] Date of Patent: Jun. 19, 1990

[54] JUNCTION BOX FOR ELECTRICAL CABLES

[75] Inventors: Horst-Helmut Tenham; Peter Neumann, both of Wuppertal; Dieter Jaag, Villingen-Schwenningen, all of Fed. Rep. of Germany

[73] Assignees: Quante AG, Wuppertal; Blumberger Telefon- und Relaisbau Albert Metz, Blumberg, both of Fed. Rep. of Germany

[21] Appl. No.: 381,586

[22] Filed: Jul. 18, 1989

[30] Foreign Application Priority Data

Sep. 29, 1988 [DE] Fed. Rep. of Germany ..... 3833032
Mar. 3, 1989 [EP] European Pat. Off. ..... 89103725

[51] Int. Cl.[5] ..... H01R 4/24
[52] U.S. Cl. ..... 439/417
[58] Field of Search ..... 439/389–425

[56] References Cited

U.S. PATENT DOCUMENTS 4,723,918 2/1988 Lacroix ..... 439/417
4,776,812 10/1988 Boissonnet et al. ..... 439/417
4,834,668 5/1989 Markwardt ..... 439/417

*Primary Examiner*—Joseph H. McGlynn
*Attorney, Agent, or Firm*—Peter K. Kontler

[57] ABSTRACT

A junction box is provided for electrical cables comprising a base; a cover; a circuit board; penetration contacts mounted on the circuit board; a cable receiving body for receiving a segment of cable therein, the body being movable back and forth and having slots therein aligned with the penetration contacts to accept the contacts therein as the receiving body is moved toward the circuit board and permit the contacts to penetrate the cable to make electrical contact with at least one conductive core therein; and a set screw for moving the body towards the circuit board and holding the body in abutment therewith.

44 Claims, 6 Drawing Sheets

FIG. 3
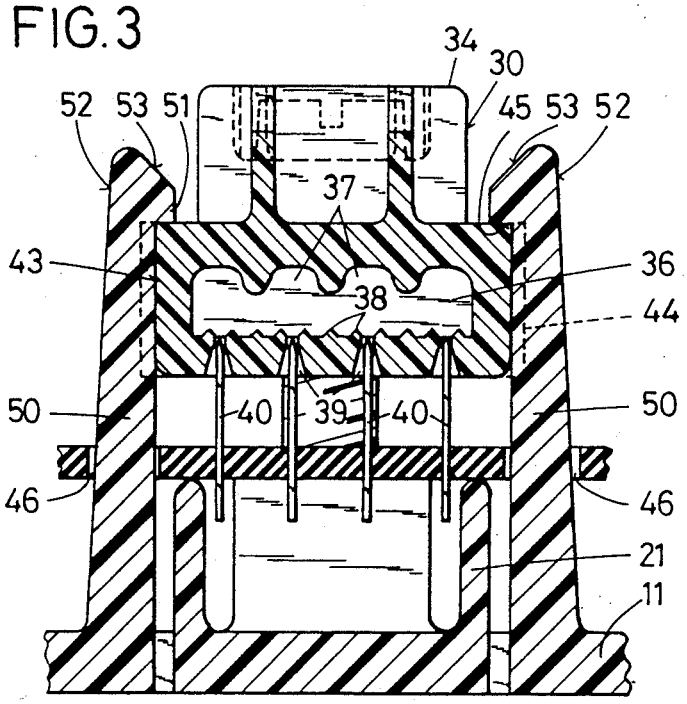
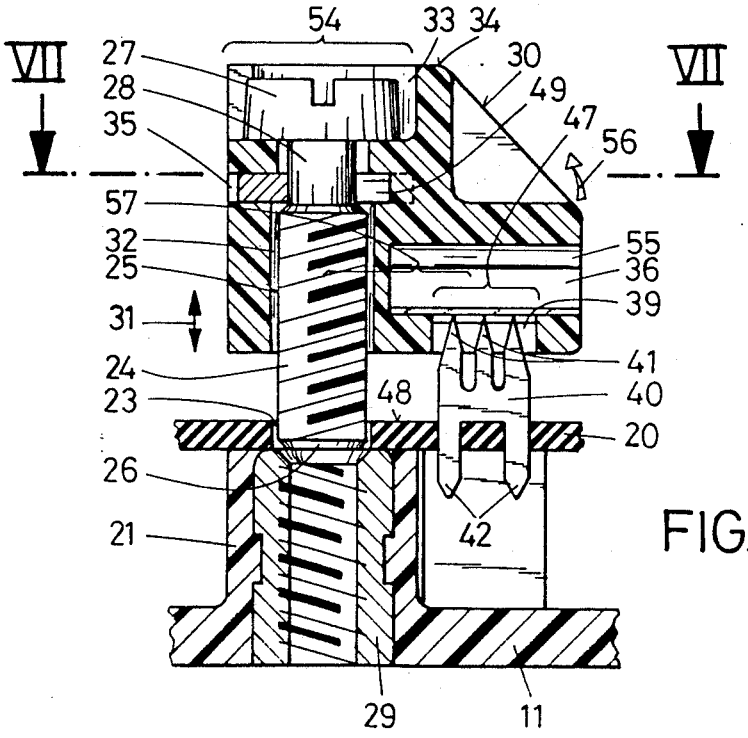
FIG. 4

FIG. 5
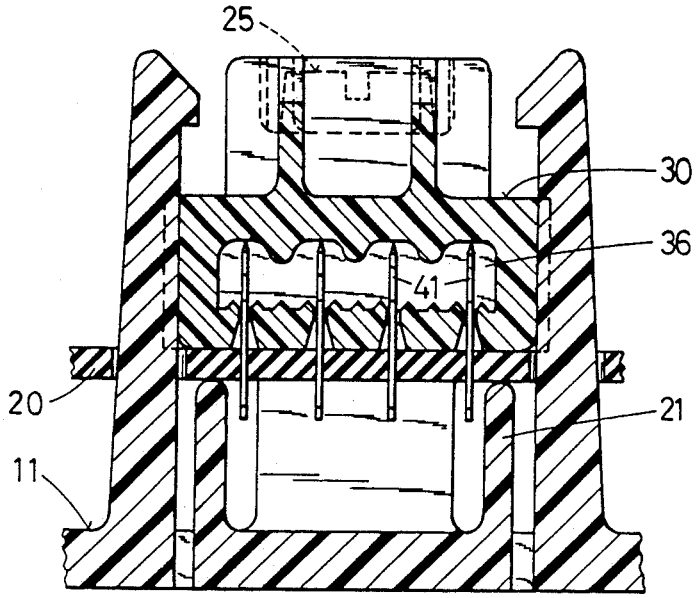
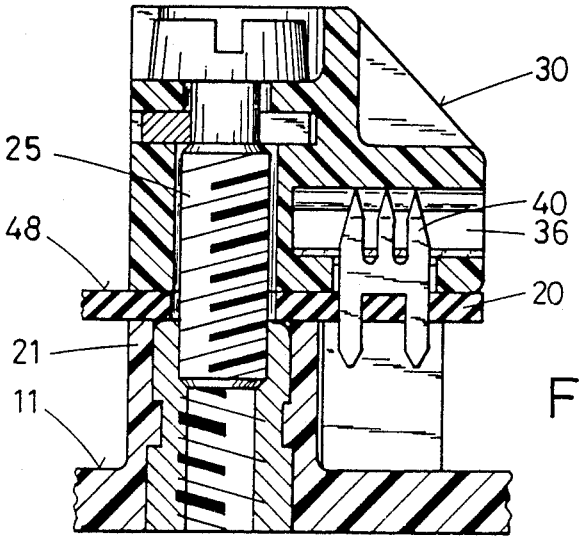
FIG. 6

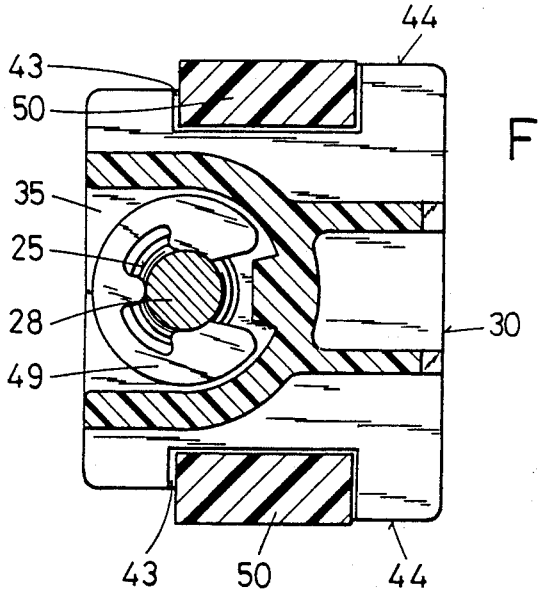
FIG. 7
FIG. 8
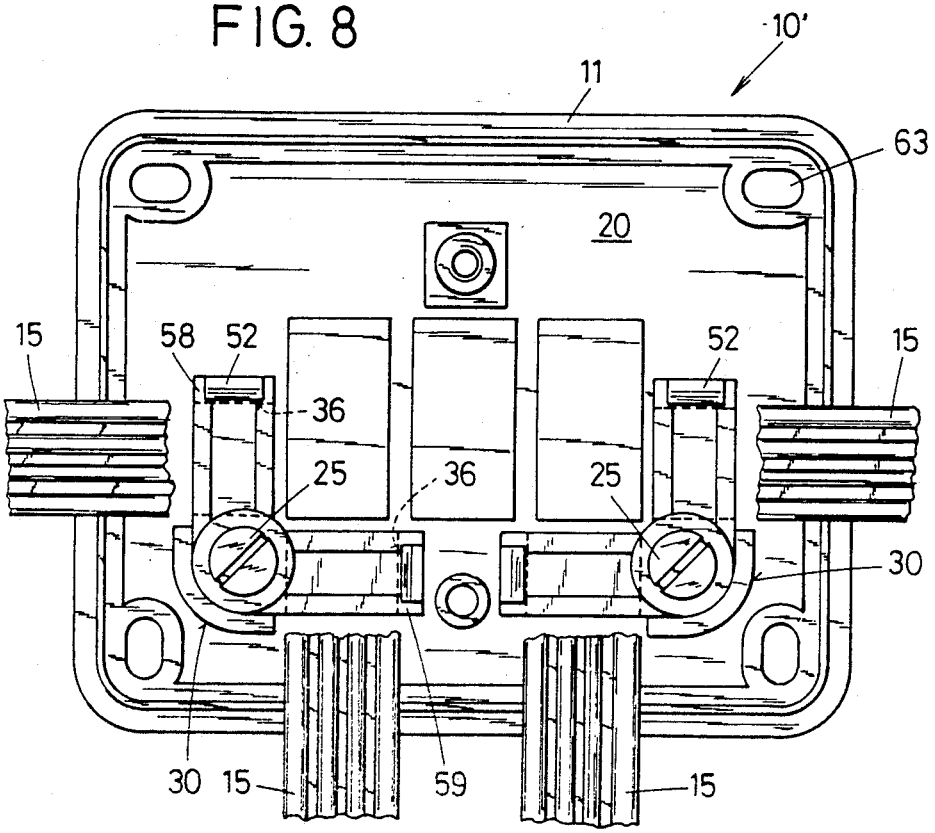

JUNCTION BOX FOR ELECTRICAL CABLES

I. FIELD OF THE INVENTION

The invention is directed to a junction box for electrical cables, particularly for flat cables of telecommunication technology containing several parallel bunched conductive cores.

II. BACKGROUND OF THE INVENTION

In German Patent No. 3,545,305-Al, components of a prior art connecting terminal were prefabricated, contacted with the printed circuit board, and arranged between a printed circuit board and a box cover. Each component consisted of a frame-shaped housing, of which the lower frame formed the support for the penetration contacts and from which connecting tongues for later connection to the printed circuit board projected. The opposite frame received a nut, which formed the threaded receiving section for a set screw supported on a pivot bearing centrally in the receiving body. The lower end of the set screw was connected in an axially fixed manner with a cable receiving body and was formed in the longitudinal center into its channel, which served for the introduction of the cable to be contacted. The set screw was arranged in the longitudinal center of the field of the penetration contacts located in the other frame, with said contacts having to penetrate with their contact blades through vertical slots into the channel of the receiving body when the set screw was turned. In the loosened state, the set screw projected above the upper frame with its screw head in an interfering manner.

The cumbersome and time-consuming fabrication of the individual components and their later assembly were a disadvantage. These components contributed to excessive overall height, for which a space with correspondingly large dimensions in a connection box was required. Also, the mechanical and electrical connection between the components and the printed circuit board was unreliable, and consequently additional fastening means, such as pins or the like, were required on the frames. However, even so adequate strength of the connection could not be adequately insured and had insufficient effect on a good electrical connection of the connecting tongues.

III. SUMMARY OF THE INVENTION

The present invention provides a reasonably priced junction or connection box with cable receiving bodies that are movable by means of set screws, a connection box which is more space-saving and is characterized by good mechanical strength and electrical contacting, and is efficiently assembled and handled.

In the present invention, the printed circuit board itself provides support for the penetration contacts and contains openings for a set screw, with a corresponding threaded receiving area located in the base of the box. The shaft end of the set screw and the screw head, which must be handled with a turning tool, are located on opposite sides of a printed circuit board. A cable receiving body contains a vertical opening for the shaft of the set screw and, as a result of actuation of the screw by means of the screw head, is pressed directly against the printed circuit board. In the tightened state, the cable receiving body can be pressed against the printed circuit board over its whole area to achieve a fixed and stabilized structure. The cable receiving body presses the connecting tongues into the printed circuit board in a mechanically and electrically reliable manner. Therefore, the set screw takes on not only the function of contacting the contact blades, but also provides a mechanical and electrical protection of the position of the penetration contacts. A low overall height is achieved, because only the cable receiving body with the screw head is located above the printed circuit board. The threaded receiving section in the base of the box can also receive a larger shaft length of the set screw and can therefore ensure a particularly good pressure contact between the cable receiving body with the properly contacted cable and the printed circuit board.

If desired, the movements of the cable receiving body can be carried out by means of guide webs to restrict horizontal displacement during tightening of the set screw. The overall height is not significantly increased thereby, because the guide webs also fit tightly at the base of the box below the printed circuit board.

A recess surrounding the screw head also limits the width of action of the turning tool or screwdriver, which reduces potential damage to the screw head by incorrect screwdrivers, and also reduces potential slippage of the screwdriver.

IV. BRIEF DESCRIPTION OF THE DRAWINGS

FIGS. 3 and 4 show transverse and horizontal sections, respectively, of a detail of the connecting terminal of FIG. 1, with the components shown in a starting or loosened position;

FIGS. 5 and 6 show a representation of the same components corresponding to FIGS. 3 and 4, but in the end or tightened position for contacting a cable (not shown);

FIG. 7 shows a horizontal section through the components of FIG. 4, along the line of intersection VII—VII;

FIG. 8 shows one alternative embodiment of the connection box according to the invention;

V. DETAILED DESCRIPTION OF THE PREFERRED EMBODIMENT

Figure 1:
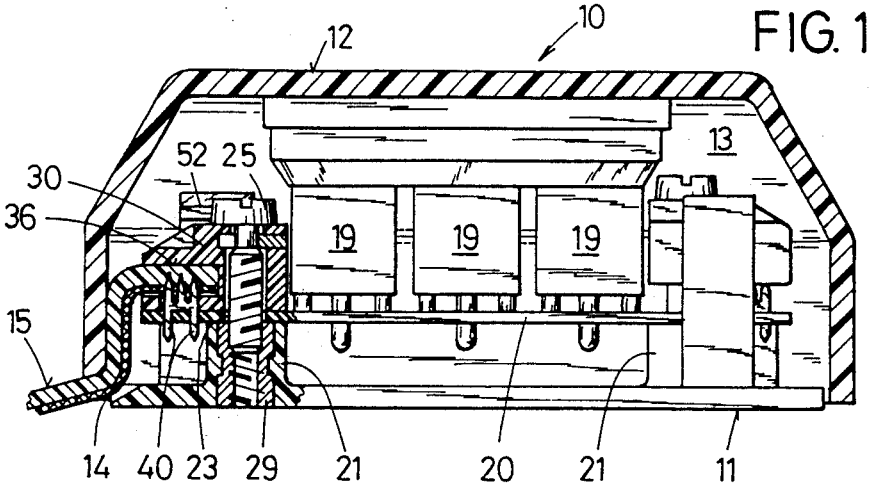
FIG. 1 shows a partial sectional view of one embodiment of a connection box according to the present invention.

FIGS. 1 through 7 show a preferred first embodiment of a junction or connection box 10 according to the present invention, which consists of a box base 11 that can be attached to a wall or the like used for installation and a box cover 12 placed above this. Electrical cables such as 15 are introduced through lateral openings 14 in the side walls of the box cover 12 into the interior 13 of the box thus formed, whose appearance can be seen best from the cross-sectional view of FIG. 1.

In the preferred embodiment, the invention is directed towards a flat cable 15 for telecommunications technology. Such a flat cable typically consists of a band-shaped web 16 on which several parallel bunched conductors 17 having conductive cores are arranged with an insulation integral with this (see FIG. 9). The flat cable has a rib profile on one side. The opposite side of the flat cable, which is formed by the band-shaped web 16, is largely planar and carries an adhesive layer 18 which, during installation of the flat cable 15, can be used for its mounting on the wall or the like. In this way, a saving in additional fastening means for such a cable 15 can be achieved. The connection box 10 has the task of electrically connecting the different bunched conductors 17 of such cables 15 with each other, and particularly with contact sockets 19. Such contact sockets 19 can carry contact tongues 64 in the interior of the socket, on either one side or both sides, as shown in FIG. 10, which tongues can be connected with associated plugs. The openings of the contact sockets 19 (not shown in detail) are directed upward as a rule and are in alignment with recesses on the top of the box cover 12 (not shown in detail). Through these recesses, the plugs can be coupled in the connection box 10.

The contact sockets 19 are supported on a printed circuit board 20, which is equipped with conducting paths in the usual manner to produce an electrical connection between the individual cables 15 to be contacted and the sockets 19. The printed circuit board 20 is parallel to the box base 11 in the box interior 13 and is supported on a framework 21 formed on the box base 11. At the top, the printed circuit boards 20 can be marginally overlapped by retaining means 22, which are also formed onto the box base 11. The retaining means 22 can be used to secure the position of the printed circuit board 20 and are supported by set screws 25, which additionally perform other functions.

The printed circuit board 20 is provided with a hole 23 in order to let the threaded shaft 24 of the set screw 25 pass through (see FIG. 4). During tightening, this shaft engages with the threaded receptacle section of a threaded sleeve 29, which is also formed into the supporting framework 21 of the box base 11. The set screw 25 is for making a special cable receiving body 30 for a cable 15 movable, such as a lifting action, in the directions of the double-headed arrow 31 of FIG. 4 with respect to the printed circuit board 20, on which are located a group of penetration contacts 40. For this purpose, the following design is provided.

The cable receiving body 30 initially embraces the vertical hole 32 for the shaft 24 of the set screw 25 (see FIG. 4). In every screw position, screw 25 rests with its screw head 27 lowered into a recess 33 at the upper end of the cable receiving body 30. This recess 33 is formed by a bead 34 on the cable receiving body 30 in the shape of a ring section. This bead 34 is torus-shaped and circumferentially surrounds the screw head 27, thereby making it difficult to use screwdrivers with an excessively wide blade as the screwing tool. Because the screw head 27 is always lowered into the recess 33 (see FIG. 4), the blade of the screwdriver can be guided during its rotary movement. The set screw 25 is also provided with an offset neck 28 to produce an annular groove which, in the case of assembly, is aligned with a slot 35 intersecting the vertical hole 32. The slot 35 is open at the sides and serves to receive a snap ring 49, which surrounds the neck 28 with legs having a spring-like action to ensure a rotatable but axially fixed connection between the set screw 25 and the receiving body 30 (see FIG. 7).

The cable receiving body 30 contains a channel 36 proceeding perpendicular to the vertical opening 32, the channel 36 serving to receive the flat cable 15. In accordance with the cable profile described above in connection with FIG. 9, the upper channel wall is equipped with longitudinal grooves 37 (see FIG. 3), with which the individual bunched conductors 17 mate to assume a defined position in the channel 36. The opposite lower channel wall is initially equipped with parallel ribs 38 proceeding in the channel direction to produce a tooth profile. Ribs 38 are in contact only at points with the adhesive layer 18 on the flat cable 15, which has already been described above in connection with FIG. 9. As a result, the cable end can be inserted into the channel 36 of the cable receiving body 30 without having to remove the adhesive layer 18 (see FIG. 1). The cable receiving body 30 is preferably made from a transparent material, to thereby permit an observer to detect the proper position of the cable end therein.

As can be seen from FIGS. 3 and 4, the receiving body 36 also contains vertical slots 39 that open into the channel 36 through the lower channel wall in alignment with the grooves 37 at the top of the channel. Such an arrangement is for achieving an alignment with the bunched conductors 17 of the introduced cable 15 that can be seen from FIG. 9. These vertical slots 39 (see FIGS. 3 and 4) contact blades 41. Several of blades 41 are preferably formed by a structuring of penetration contacts 40. The blade points are slightly laterally displaced with respect to each other, in order to be able to pierce the bunched conductors 17 at different points of the cross-section in the penetration process to electrically contact the electrically conductive cores. Vertical slot 39 is provided with inclined walls proceeding convergently toward each other, which walls during the lifting movement 31 of the cable receiving body 30 serve for guidance of the contact blades 41.

The penetration contacts 40 contain contact tongues 42 directed downward or opposite from the rising contact blades 41. Contacts 40 are preferably made integral with blades 41 and are introduced into the printed circuit board 20 in permanent electrical connection therewith and the previously mentioned conducting paths by means such as soldering or the like. This is because the cable receiving body 30 is located directly above the top 48 of the printed circuit board 20 (see FIG. 4) and abuts or cooperates therewith over its whole area when the cable receiving body 30 is moved from the starting position of FIG. 4 into the end position of FIG. 6 in a direction of the previously mentioned arrow 31. Such movement is carried out by means of the set screw 25.

Such movement is guided by a pair of guide webs 50 which as shown in FIG. 7 are arranged on the two side surfaces 44 of the cable receiving body 30 and engaged there in grooves 43. These guide webs 50 (see FIG. 3) are also formed on the box base 11 and preferably include hooks 52 that are mirror images of each other. Hook legs 50 provide the function of the above-mentioned guide webs, while the hook ends 51 produce stops for the upper lifting position of the cable receiving body 30 according to FIGS. 3 and 4. The counter-shoulder 45 for this hook end 51 in this case is formed by the upper front end of the cable receiving body 30 itself. In this upper lifting position, as is seen best from FIG. 4, the shaft end 26 of the set screw 25 is not engaged with its threaded receptacle sleeve 29, so that further upward movement of the cable receiving body 30 as a result of unscrewing of the set screw 25 is not possible. The hook legs 50 as seen in FIG. 3 pass through corresponding openings 46 in the printed circuit board 20, but alternatively the hook legs 50 could also marginally embrace the printed circuit board 20 in this region. The cable receiving body 30 is held in position according to FIGS. 3 and 4 by means of these hooks 52, despite the loosened set screw 25. At the same time, the printed circuit board 20 is also held in its position by means of the above-mentioned penetration contacts 40.

The hooks 52 permit a snap installation of the cable receiving body 30 above the finished printed circuit board 20 supporting the penetration contacts 40. For this purpose, the hook ends 51 are provided with inlet bevels 53 as shown in FIG. 3 that are mirror images of each other and against which the cable receiving body 30 moves during its vertical insertion movement. Body 30 briefly spreads the hooks 52 apart in an elastic manner. The hook ends 51 then snap over the upper front end 45 of the cable receiving body 30, which comes to be located between the hook legs 50 in the end position. In this process, the contact blades 41 also move through the slots 39 in the receiving body. The connection box prepared in this manner is suitable for contacting with the various flat cables 15.

Figure 2:
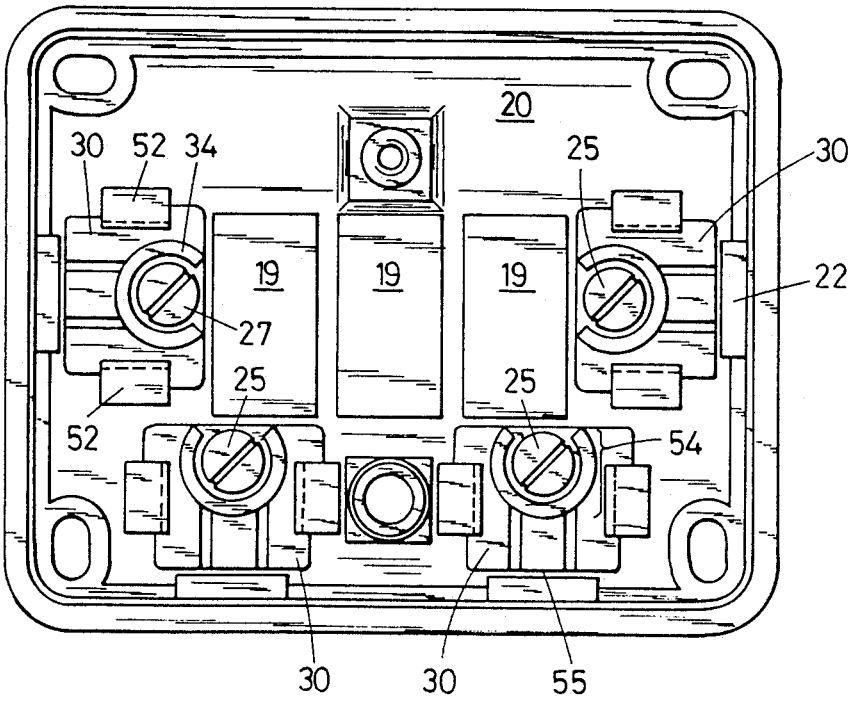
FIG. 2 shows a top view of the connection box of FIG. 1 with the box cover removed, to show a view of the components arranged at the base of the box.

As can be seen from FIG. 2, such receiving bodies 30 are provided for a single cable end in each case at different desired points in the box and can also be actuated independently by means of separate set screws 25. If a flat cable 15 is introduced properly into the channel 36 of the cable receiving body 30 in question, then the corresponding set screw 25 is screwed in. As a result, the cable receiving body 30 moves downward in the direction of the lifting or movement arrow 31 of FIG. 4, the contact blades 41 penetrate increasingly into the channel 36 and the cable finally also hitting the cores of the bunched conductors 17. An electrical resistance is, of course, produced in this process.

In the present case, as can be seen from FIG. 4, the region 47 over blades 41 is in a lateral displacement 57 with respect to the location of the set screw 25 in the cable receiving body 30. This is because the set screw 25 is located in one end region 54 of the cable receiving body, while the channel opening 55 opens out at the opposite end of the cable receiving body 30. The vertical hole 32 surrounds the screw shaft 24 with a clearance, as can be seen from FIG. 4. The above-mentioned displacement 57 between the region of action 47 of the penetration contacts and the point of action of the screw 25 establishes a lever arm, which leads to a slight inclination of the cable receiving body during tightening of the set screw 25 in the direction of the tilting-movement arrow 56 shown in FIG. 4. This results in the channel 36 also being inclined correspondingly and, therefore, the adjacent individual points of the contact blades 41 penetrate into the cable sequentially in time when the cable receiving body 30 is moved against the printed circuit board 20 during actuation of the screw. However, this then results in an areawise contact between the top 48 of the printed circuit board 20 and the cable receiving body 30, in which the penetration contacts 40 are kept pressed into the printed circuit board 20 by the cable receiving body 30, as can be seen from FIGS. 5 and 6. In this case, the set screw 25 passing through the printed circuit board 20 has been screwed into the threaded sleeve 29 and has brought the cable receiving body 30 into its lower position. The penetration contacts 40 have crossed the channel 36 with their contact blades 41 up to the opposite channel wall and have thus come into good electrical contact with the conductive cores of the bunched conductors of the flat cable 15 (which is not shown in FIGS. 5 and 6 for reasons of clarity). Finally, by means of the tightened set screw 25, the printed circuit board 20 is also kept pressed against the supporting framework 21 of the box base 11 by the cable receiving body 30. The cable receiving body 30 thus carries out the additional function of holding the printed circuit board 20 firmly against the box base 11. At the same time, the penetration contacts are secured against the printed circuit board 20 in mechanical and electrical respects by the cable receiving bodies 30.

FIG. 8 shows an alternative embodiment 10' of the present invention that is intended for the contacting of four flat cables 15. The same reference numbers as in the first embodiment are used for the identification of corresponding components. However, in this embodiment, which is otherwise similar to the one described above, the cable receiving bodies 30' of embodiment 10' comprise two branches 58, 59, each of which is equipped with a previously described channel like 36 for the reception of a flat cable end. The printed circuit board 20 correspondingly also contains regions aligned with both branches, including penetration contacts that are effective in the previously described manner. The two branches 58, 59 are at an angle to each other, preferably as in the present case at right angles to each other. A single set screw 25 for both branches 58, 59 is located at the point of the angle between the branches. In this embodiment, the cables 15 can, in each case, be introduced at an angle to each other in the connection box 10'. The box base 11 can be mounted by screw fastening or the like, for which purpose penetrations 63 are provided in the corner region of the base. However, the box base 11 could also be adhered by means of an adhesive layer on the back to the wall.

Figure 9:
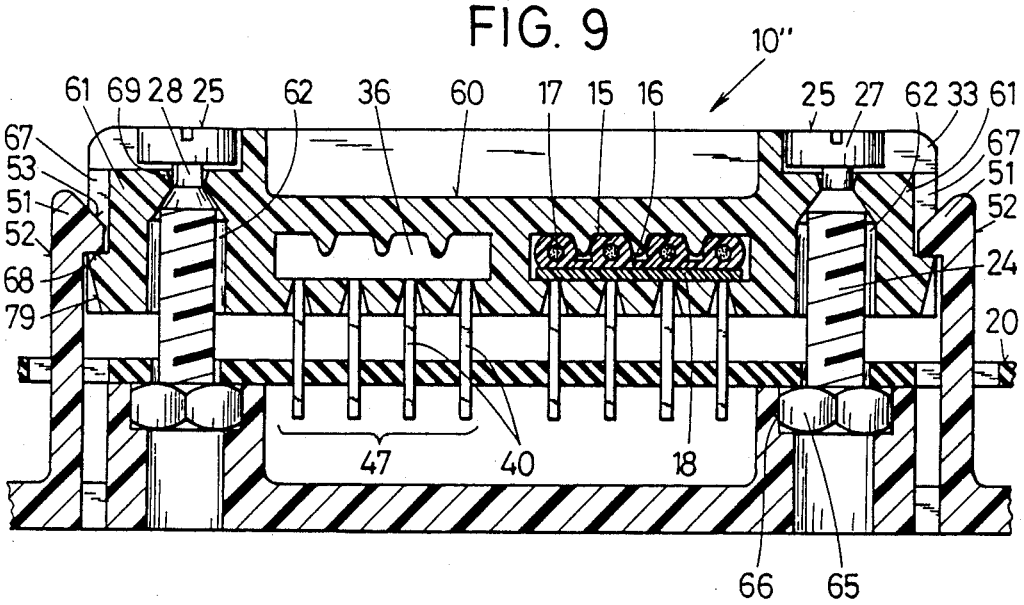
FIG. 9 shows another embodiment of the connection box according to the invention.
Figure 10:
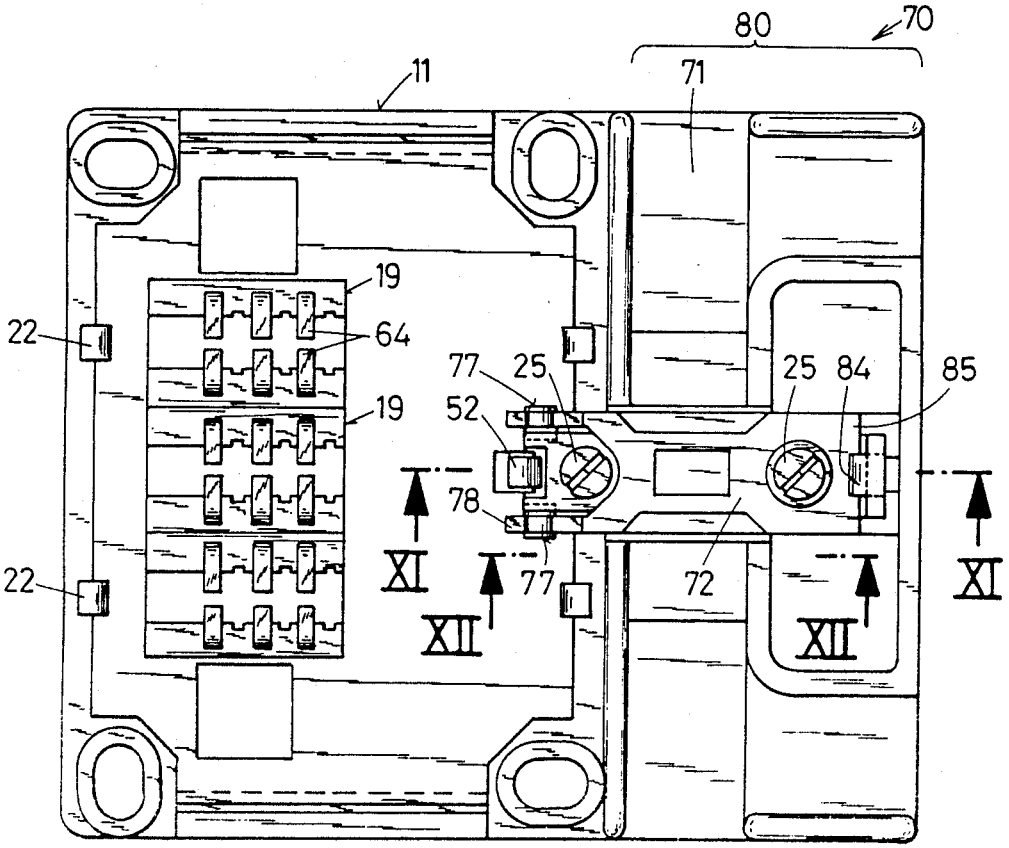
FIG. 10 shows another embodiment of the connection box according to the invention.

FIG. 9 shows yet another alternative 10'' of a connection box of the present invention, but only as a fragment in a representation analogous to FIG. 3. Here again as in FIG. 8, corresponding components are identified by the same reference symbol and, to this extent, reference is made to the previous description. It is sufficient merely to describe the additional measures.

The cable receiving body in this case consists of a bridge 60 provided with vertical holes 62 for passage of set screws 25 at both bridge ends 61. In the section located between these, the bridge 60 is provided with several channels 36 for the reception of cable ends 15 and corresponding regions 47 with corresponding penetration contacts 40 as previously described. The set screws 35 are provided with a threaded receptacle section under the printed circuit board 20 in the form of a nut 65, which is housed in a corresponding non-circular recess 66 of the box base 11 and is covered there by printed circuit board 20.

The box base 11 contains formed-on hooks 52 for engaging an end-side groove 67 with their hook ends, where a stop surface 68 as an end stop cooperates with the hook end 51 when the bridge 60 is located in its upper lifting position according to FIG. 9. In this case, the set screws 25 are engaged with their neck 28 with projections 69 constricting the vertical hole 62, such that the screw heads 27 are always in a position flush with recesses 33 at the top of the bridge 60. The length of the threaded shafts 24 is dimensioned in such a way that, in the upper position of FIG. 9, there is not yet any engaged relationship with the nut 65.

The installation of the bridge 60 with the two hooks 52 is carried out in the manner already described for the first embodiment. To facilitate the snap-in movement of the hooks 52, a wedge surface 79 in a direction opposite to the previously mentioned inlet bevels 53 of the hooks is located below the stop surface 68, and is provided in the lower region of the grooves 67 at both ends of the bridge 60. For the contacting of the introduced cable ends 15, the two set screws 25 are screwed in a manner coordinated with each other. The lowering movement of the bridge 60 is controlled by the hook ends 51, which slide in the grooves 67.

Figure 11:
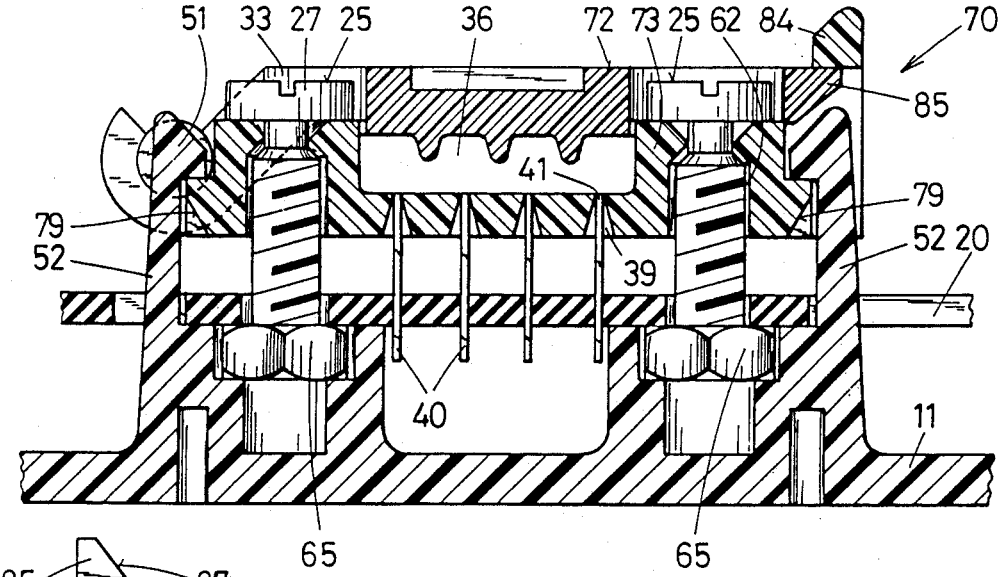
FIG. 11 shows an enlarged sectional view through FIG. 10 along the line of intersection XI—XI.
Figure 12:
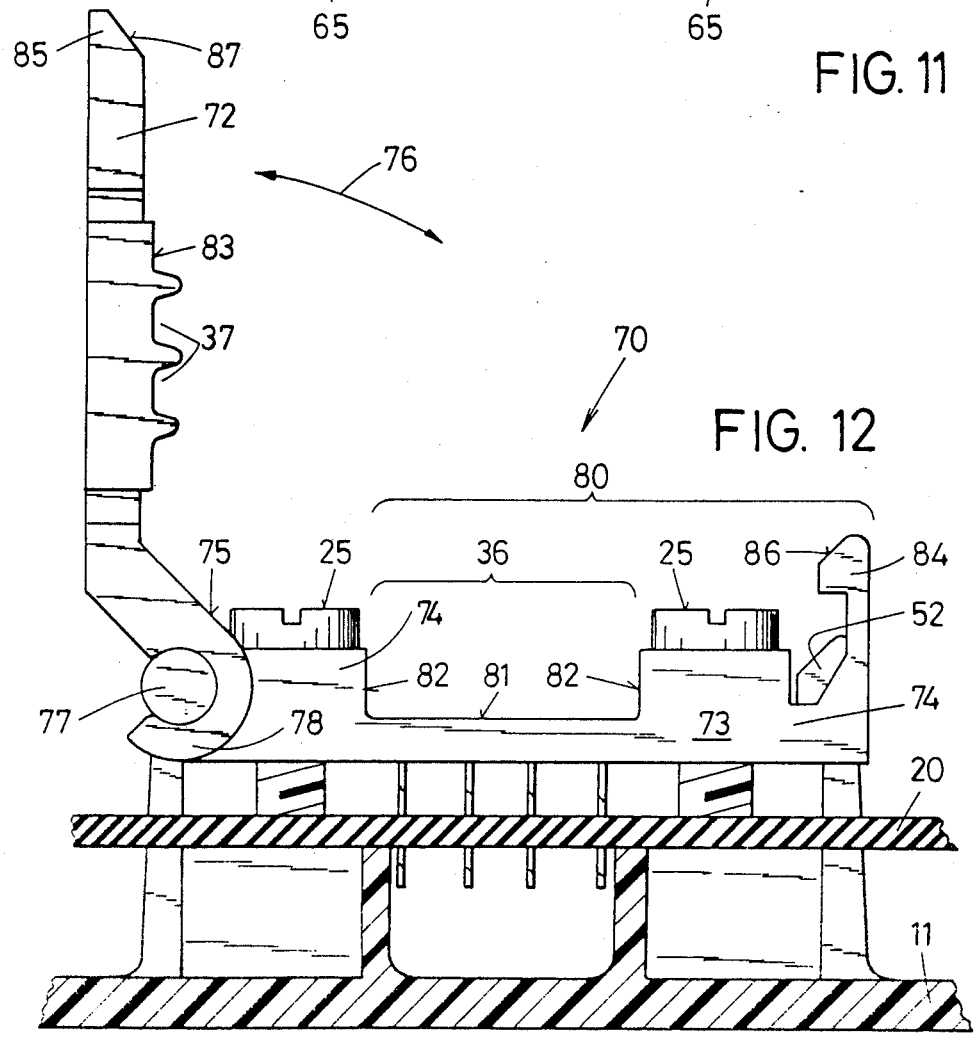
FIG. 12 shows a representation of the important components analogous to FIG. 11, but along a different line of intersection, namely along XII—XII of FIG. 10, and in a different position of the components involved.

In FIGS. 10 through 12, yet another embodiment of a connection box 70 in accordance with the present invention is shown in top view and in the form of individual parts, of which also only the forms different from the preceding embodiments need to be described. In other respects, the previous description applies.

A special feature of the embodiment shown in FIGS. 10 through 12 consists of the fact that the box base 11 has a continuous cable channel 71, which makes possible the subsequent connection of the connection box 70 to an already installed cable, without having to cut the cable at this point. For this purpose, this box 70 contains a cable receiving body in two parts 72, 73 that are superposed in the assembled state (see FIGS. 11 and 12). This cable receiving body is also in the form of a bridge with two set screws 25 provided in the two end regions 74 of the lower part 73. These are mounted in a similar manner to that in the embodiment of the connection box 10'' of FIG. 9 and cooperate with corresponding nuts 65 located below the printed circuit board 20. Here again, hooks 51 are provided for a limitation of the upper lifting position and for guiding the cable receiving body during the contacting of the cable, which is not shown in greater detail here.

The upper part 72 of the cable receiving body is connected with the lower part 73 through a link 75, so as to be tiltably movable along the direction of the arrow 76. This purpose is achieved in the present case by means of a formed-on pin 77 in an end region 74 of the lower part 73 and by a knuckle eye 78 on the upper part 73, which has a forked shape in this case. The upper part 72 thus acts like a tiltable lever. When in the raised position of FIG. 12, the receiving channel 36 is open toward the top for a continuous cable. The box 70 can therefore be pushed with the marginal region 80 of the base 11 visible from FIGS. 10 and 12 under the cable, which can then be inserted into the lower channel half in the lower part 73, which comprises the channel base 81 and the channel side walls 82. The upper part 72, on the other hand, contains only the corresponding channel cover wall 83. Alternatively, higher regions of the channel side walls 82 can also be provided in the upper part 72. In this case also, the channel top wall 83, on the basis of its profiling, produces the previously mentioned receiving grooves 37 for the insulated conductors 17 formed onto the flat cable on one side. If, therefore, the cable has been inserted into the lower half of the channel 36 of the lower part 73, then, upon closing of the upper part 72, the cable is precisely aligned with the individual penetration contacts 40, which are arranged in the printed circuit board in this case also. This closed position, as shown in FIGS. 10 and 11, is secured by a snap closure 84, 85. This consists of a stop hook 84 formed on the end 74 of the lower part 73 that is opposite to the link 75. Its hook shaft is flexible and also contains an inlet bevel 86 which, during closing of the upper part 72, cooperates with the free end 85 of the upper part 72 located there, which has an opposite bevel 87. After this elastic deformation, the end 85 snaps under the stop hook 84 (see FIG. 11). In this way, the receiving channel 36 for the cable is closed. The contacting of the cable with the penetration contacts 40, in the manner already described several times, now takes place through a coordinated movement of the two set screws 25. For this purpose, the upper part 72 contains openings 33 which, in the closed position, are aligned with the screw heads 27 in the lower part 73, and which, as recesses, arrange said screw heads in a depressed manner. The upper part 72 acts like an "eyeglass frame" for the screw heads 27.

It is understood that the terms such as "upwards", "downward", "inward", "outward", "above", "below", "lower", and "raise" are used to show relative motion and direction only and are not intended to be limiting of the scope of the invention in any way.

It should be understood that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A junction box for electrical cables comprising:

(a) a base;

(b) a cover for extending over at least a portion of said base, said cover having at least one opening formed therein for receiving at least one electrical cable having a conductive core therethrough;

(c) an insulating member fixedly mounted on said base for supporting thereon at least one electrically conductive path;

(d) electrical contact means mounted on said insulating member in electrical communication with said path, said contact means including penetration means for penetrating the at least one electrical cable to make electrical contact with said core, said penetrating means extending outwardly from said member in a predetermined direction;

(e) means for receiving a segment of said electrical cable inserted therein, said cable receiving means being movably mounted on said insulating member to be movable back and forth in said predetermined direction in a generally rectilinear manner, said cable receiving means further having formed thereon on a side thereof towards said penetrating means at least one opening aligned with said penetrating means for accepting said penetrating means at least part way into said cable receiving means as said cable receiving means is moved towards said member; and (f) means extending from said base, through an opening in said insulating member, and to said cable receiving means for moving said cable receiving means toward said insulating member to cause said penetrating means to extend through said opening and penetrate at least part way into said cable segment inserted into said cable receiving means to make electrical contact with said core.

2. The junction box of claim 1, wherein said cable receiving means has a surface facing said insulating member and when moved in a farthest position towards said base abuts said insulating member over substantially said entire surface.

3. The junction box of claim 1, wherein said cable receiving means comprises transparent material, whereby said cable segment can be viewed.

4. The junction box of claim 1, wherein said cable receiving means includes a bridgemember having formed towards opposite ends thereof a pair of bores, and said moving means includes a pair of screw means for extending through said pair of bores respectively to engage a corresponding pair of threaded receptacle means formed in said base, and said bridge member has formed between said opposite ends at least one channel for receiving at least one cable segment.

5. The junction box of claim 1, wherein said base includes at least one threaded receptacle means corresponding to an elongated threaded member, said insulating member includes an opening therein for permitting said threaded member to pass through, and said cable receiving means has formed therein a bore for permitting said threaded member to pass through, said threaded member also having forming in one end thereof means for engaging said cable receiving means and said moving means includes said threaded member for pulling said cable receiving means toward said insulating member when said threaded member is rotated about its axis.

6. The junction box of claim 5, wherein said cable receiving means forms a channel therein generally transverse to said bore for receiving an end segment of said cable.

7. The junction box of claim 6, further including guide means mounted on said base and extending in said direction beyond said insulating member, said guide means having a pair of opposing sidewalls facing each other spaced for slidingly guiding said cable receiving means in said rectilinear manner.

8. The junction box of claim 4, wherein said opposing sidewalls form hook means for engaging shoulder portions of said cable receiving means to delimit travel of said cable receiving means in a direction away from said base when said cable receiving means has been inserted into said guide means.

9. The junction box of claim 8, wherein said elongated threaded member comprises set screw means and when said cable receiving means is positioned at the furthest point of travel away from said base, said set screw means is disengaged from said threaded section.

10. The junction box of claim 8, wherein said guide means are formed of elastic material and said sidewalls include means adjacent said hook means for spreading said sidewalls apart in response to said cable receiving means being inserted into said guide means from a position beyond the delimited travel of said cable receiving means.

11. The junction box of claim 10, wherein said cable receiving means has formed therein grooves for cooperating with said sidewalls to maintain alignment of said cable receiving means.

12. The junction box of claim 11, wherein said cable receiving means at an end opposite said insulating member has formed therein a recessed portion for receiving a screw head associated with said elongated threaded member for depressing said screw head into said cable receiving means.

13. The junction box of claim 1, wherein said cable receiving means includes a pair of channels for receiving a pair of cable segments therein.

14. The junction box of claim 13, wherein said pair of channels extend in directions generally perpendicular to each other.

15. The junction box of claim 1, wherein said cable receiving means includes first and second cable receiving members that form at least one channel for insertion therein of said cable segment, and said first and second cable receiving members are separable in a direction transverse to said channel for receiving therein said segment.

16. The junction box of claim 15, wherein one of said cable receiving members is for mounting to said base and the second of which is for separating away from said first one cable receiving member, and said first one cable receiving member has formed therein said opening aligned with said penetrating means.

17. The junction box of claim 16, wherein said second cable receiving member is mounted for tilting away from said first one cable receiving member.

18. A connection box for electrical cables comprising:

(a) a base;

(b) a base cover;

(c) a circuit board supported on said base having conducting paths and penetration contacts located directly on said circuit board and electrically connected with said conducting paths, said penetration contacts containing contact blades for penetrating into at least one conductor associated with at least one of said lines;

(d) at least one threaded receptacle section formed in said base for a shaft end of a set screw for passing through an opening in said circuit board and through a vertical hole of a cable receiving body, said screw having a shaft connected in an axially fixed but freely rotatable manner to said cable receiving body, said screw having a head for engaging a top portion of said cable receiving body, said cable receiving body being located outwardly from said circuit board and, by rotation of said screw with respect to said circuit board, being pressed against a portion of said circuit board equipped with said contact blades, whereby said printed circuit board on said base is secured to said cable receiving bodies; and (e) said cable receiving body forming slots facing the printed circuit board and opening into a channel cable formed transverse to said hole for the insertion of the cable to be contacted, said slots being aligned with said conductors of said cable to be inserted into said channel, said contact blades being guided during movement of said cable receiving body into said slots.

19. A connection box in accordance with claim 18, wherein said cable receiving body in its engaged position abuts said circuit board over the whole area of said cable receiving body.

20. A connection box in accordance with claim 18, wherein said cable receiving body comprises transparent material to thereby permit a view of a cable end introduced into said channel.

21. A connection box in accordance with claim 18, wherein said cable receiving body further comprises two superposed parts operable to open the channel in an upward direction for the insertion of a cable.

22. A connection box according to claim 18, wherein said base includes at least one pair of protruding guide webs passing through said circuit board for slidingly guiding opposite side surfaces of said cable receiving body as said cable receiving body is moved.

23. A connection box according to claim 22, wherein said guide webs include legs having hook ends formed therein as mirror images of each other, said hook ends for overlapping lateral shoulders of said cable receiving body for limiting outward movement of said cable receiving body.

24. A connection box in accordance with claim 23, wherein said hook ends are provided with inlet bevels that are mirror images of each other for spreading said webs apart in an elastic manner when said cable receiving body is pressed therebetween.

25. A connection box in accordance with claim 24, wherein said cable receiving body has side surfaces forming grooves for mating with said guide webs.

26. A connection box according to claim 25, wherein said lateral shoulders are formed by an upper front end of said cable receiving body.

27. A connection box according to claim 26, wherein said lateral shoulders are produced by a surface in said grooves.

28. A connection box in accordance with claim 28, wherein a wedge-shaped surface opposite to said inlet bevels is arranged on said cable receiving body adjacent said grooves.

29. A connection box in accordance with claim 18, wherein said cable receiving body has a recess at its upper end corresponding to a circumference of said screw head for accepting said screw head in a depressed position for each position of said set screw.

30. A connection box in accordance with claim 29, wherein said recess is torus shaped.

31. A connection box in accordance with claim 18, wherein in the outermost position of said cable receiving body, said shaft end of said set screw is disengaged from the threaded receptacle section in said base.

32. A connection box in accordance with claim 31, wherein said threaded receptacle section includes nut means located in a non-circular recess of said base and covered by said printed circuit board.

33. A connection box in accordance with claim 18, wherein said channel has a channel wall including parallel ribs pointing in a channel direction to provide a tooth profile.

34. A connection box in accordance with claim 33, wherein a single screw means is arranged adjacent one end of said cable receiving body.

35. A connection box in accordance with claim 34, wherein said screw means is for passing through said hole of said cable receiving body with a lateral clearance, said cable receiving body for tilting during tightening of said screw means in response to the penetration of the cable.

36. A connection box in accordance with claim 35, wherein said cable receiving body contains two blades, one such blade being on either side of said hole receiving said set screw, with at least one continuous channel in each blade for introduction of one cable into each channel.

37. A connection box in accordance with claim 36, wherein the two blades are positioned at an angle to each other.

38. A connection box in accordance with claim 37, wherein said cable receiving body includes a lower part having the vertical slots for the contact blades, a channel base with opposing channel side walls and holes for screws, and the upper part includes a channel cover wall and recesses for screw heads.

39. A connection box in accordance with claim 18, wherein said cable receiving body comprises bridge means with vertical holes for a pair of set screws located at both ends of said bridge means, and at least one channel in said bridge means for receiving the cable.

40. A connection box in accordance with claim 39, wherein said upper part is tiltably movable with respect to the lower part of the receiving body.

41. A connection box in accordance with claim 40, wherein the upper and lower parts are connected with each other through a link at one end and by means of a snap closure at the other end.

42. A connection box in accordance with claim 39, further including an axially fixed but rotatable connection between the set screw and the bridge comprises an annular groove in the screw shaft and an elastically yielding projection formed in said bridge means and surrounding a vertical hole.

43. A connection box in accordance with claim 42, wherein the axially fixed but rotatable connection between the set screw and the cable receiving body includes an annular groove in the screw shaft and a snap ring for inserting into a slot in the cable receiving body and passing through the vertical hole and open at the sides.

44. A junction box for electrical cables having a shape characterized by a generally rectangular cross-section and a plurality of electrically conductive cores spaced laterally in a single layer across said cable in a parallel configuration, said conductive cores being separated by uniform lateral distances, said junction box comprising:

(a) a base;

(b) a cover including plug receptacle means for coupling with at least one electrical conducting means;

(c) circuit board means mounted on said base, said circuit board means forming electrically conductive paths thereon and having plug socket means for operatively coupling to said electrical conducting means;

(d) electrically conductive blade means mounted on said circuit board means in electrical communication with chosen ones of said paths, said blade means extending from said circuit board means for piercing said cables to engage said cores;

(e) a transparent cable receiving body that is movable from a raised position to a lowered position, said cable receiving body having formed therein at least one channel for receiving therein at least one of said cables, said cable receiving body also having a plurality of slots open to said channel and corresponding to said blade means, said slots for permitting said blade means to enter said channel and pierce said cable, said cable receiving body also having a hole therethrough transverse to said channel and aligned in a direction from said raised position toward said lowered position;

(f) screw means for extending through said hole to engage a nut located in a non-circular recess in said base below said circuit board means, said screw for being rotated to tighten said cable receiving body against said blade means to force said blades into electrical contact with said cores; and (g) at least one pair of guide legs mounted on said base, each leg having a hook shaped portion adjacent ends thereof opposite said base, said guide legs passing through said circuit board means to lockingly engage a shoulder portion of said receiving body with said hook-shaped portions.

* * * * *